US006640786B2

(12) United States Patent
Peng

(10) Patent No.: US 6,640,786 B2
(45) Date of Patent: Nov. 4, 2003

(54) MICRO-PULSATION METERING FUEL INJECTION SYSTEM

(75) Inventor: Yu-Yin Peng, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 133 days.

(21) Appl. No.: 09/888,130

(22) Filed: Jun. 23, 2001

(65) Prior Publication Data

US 2002/0148449 A1 Oct. 17, 2002

(30) Foreign Application Priority Data

Apr. 13, 2001 (TW) ..... SN.90108860 A

(51) Int. Cl.[7] ..... F01M 37/04
(52) U.S. Cl. ..... 123/498; 123/495
(58) Field of Search ..... 123/495, 598; 239/101, 102.2; 417/413.2, 410.2

(56) References Cited

U.S. PATENT DOCUMENTS 3,961,616 A * 6/1976 Brown ..... 123/545
4,327,675 A * 5/1982 Takeda ..... 123/470
4,922,876 A * 5/1990 Mizoguchi et al. ..... 123/470
5,593,290 A * 1/1997 Greisch et al. ..... 417/478
6,116,517 A * 9/2000 Heinzl et al. ..... 239/101

* cited by examiner

*Primary Examiner*—Mahmoud Gimie
(74) *Attorney, Agent, or Firm*—Pro-Techtor International Services

(57) ABSTRACT

A micro-pulsation metering fuel injection system, comprising a throttle body and at least one injection unit. The throttle body is mounted in an inlet pipe of a cylinder of an internal combustion engine for controlling a quantity of flow of air into a combustion chamber. The injection units are mounted on the throttle body and have each a plurality of micro-pumps. The micropumps suck in fuel and inject tiny droplets of fuel into an air inlet inside the throttle body, so that the droplets of fuel mix with air in the throttle body, creating a mixture, which enters the combustion chamber of the cylinder. A control unit senses operating parameters of the engine and drives the injection units via a driver unit. This allows precisely to control the quantity of injected fuel and flexibly to control the distributing fuel spray, resulting in higher fuel efficiency and lore exhaust emission.

19 Claims, 6 Drawing Sheets

MICRO-PULSATION METERING FUEL INJECTION SYSTEM

FIELD OF THE INVENTION

The present invention relates to a micro-pulsation metering fuel injection system, particularly to a micro-pulsation metering fuel injection system to be used in an internal combustion engine.

DESCRIPTION OF RELATED ART

Fuel supply systems of conventional internal combustion engines include carburetors and electrical fuel injection systems. As shown in FIG. 8, a mechanical carburetor 60, using under pressure generated by flow in a tube, sucks in and atomizes fuel. The carburetor 60 mainly comprises a throttle body 70, controlling inflow of air, and an adjustment needle 61, controlling intake of fuel. Atomized fuel, having mixed with air, enters cylinders of the internal combustion engine. As shown in FIG. 9, an electrical injection system has an electric fuel pump 80. The electric fuel pump 80 pressurizes fuel, which is subsequently pushed out through an injector 81 and by mechanical force ripped apart into a fuel beam and fuel droplets, entering an inlet manifold 71 at high pressure. Thus fuel droplets are injected into cylinders of the internal combustion engine in air inducing process.

However, conventional carburetors developed to the present day have become complicated precision devices, which makes manufacturing thereof difficult and expensive. Being regulated by an inclination of the adjustment needle and flow control by the throttle valve, the quantity of fuel taken in is not easy controlled. There is also no way to regulate the quantity of fuel taken in by computer control, nor to accommodate a widely varying pattern of demand for fuel, while maintaining a proper fuel-to-air ratio. Furthermore, using a throttle valve results in imperfect atomization, so that wall-wetting happen in the inlet pipes of the cylinders. For these reasons, conventional carburetors, while being complicated and expensive, are not able to control combustion in the engine.

On the other hand, a fuel injection system, requiring a pressurizing pump, a high-pressure pipe, a regulating valve, a pressure stabilizer and an injector has a large number of structural parts. Since working pressure closests 3 $kg/m^2$, sealing pipes and the pump requires special attention to prevent leakage. Therefore, a fuel injection system is expensive to make and thus only used in cars and heavy motorcycles. In these, electrical fuel injection systems are frequently encountered, but for light motorcycles only a small number of manufacturers have considered using fuel injection systems.

Concerning safety, since a fuel injection system has pipes under pressure, a collision or burst of the pipes for another reason causes a fuel jet to spurt out at high speed, forming fuel vapor which is readily ignited by a spark or heat (e.g. of a catalytic converter). This is a severe safety drawback.

Although fuel injection systems, by using electric control, precisely maintain a proper fuel-to-air ratio, ejection of fuel at high pressure and speed results in fuel droplets of non-uniform sizes (usually more than $100\mu$ SMD-sault mean dia), so that fuel does not completely mix with air. Being ejected at high speed (over 20 m/sec), fuel first hits the wall of the inlet pipe, aggravating the problem of wetted walls and unused fuel.

BACKGROUND OF THE INVENTION

Due to great progress of micromechanical and microelectronics production processes in recent years, along with research on a large scale, micropumps have been commercialized in inkjet printers, constituting the richest and greatest product and technique for research in fuel injection systems.

The main area of application of micropumps are printer heads. There are two types, thermal bubble and piezoelectric micropumps. A thermal bubble micropump, as shown in FIG. 6, has a silicon substrate 1, on which a polycrystalline silicon layer 2 is laid, with insulation layers 8, 9 placed in between. Metal wires 7 run along between the insulation layers 8 and 9. A dry film 3 is spread on the polycrystalline silicon layer 2. A flow path and an electric circuit are engraved into the dry film 3, so that a plurality of ejection chambers 4 are formed. A nozzle plate 5 is glued on the dry film 3. The nozzle plate 5 is made by galvanic patterns and has ejection holes 6 that correspond to the ejection chambers 4. Liquid flows through flow paths into ejection chambers 4, then heat is generated by an electric current through the layer below the polycrystalline silicon layer 2, causing liquid in ejection chambers 4 to evaporate, forming bubbles which drive out liquid through the ejection holes 6.

A piezoelectric micropump, as shown in FIG. 7, has a substrate 1A on which a membrane 2A is laid, with chambers 3A left in between. The chambers 3A take in liquid. Piezoelectric material 4A is laid on the membrane 2A. Applying a varying electric voltage to the piezoelectric material 4A leads to mechanical shifting thereof, taking along the membrane 2A. Thus liquid in the chambers 3A is compressed and driven out through ejection holes in the substrate 1A.

The main characteristic of micropumps is that the quantity of liquid driven out is exactly controllable and that a tiny nozzle is used, so that very small droplets form, leading to good vaporization of liquid. Since micropumps are made by a semiconductor manufacturing process, it is possible to place a large number of tiny nozzles on a small area, and costs of mass production are low. Furthermore, liquid in micropump is subject to capillarity and moves by natural force, without any need to apply pressure. This keeps the structure of flow paths and a liquid supply system simple. With exact controllability and low cost of production, micropumps have an ever increasing range of applications.

SUMMARY OF THE INVENTION

The technique of the micro-pulsation metering fuel injection system of the present invention lies in several injection units placed above the throttle valve of an engine. For the several injection units, any type of micropump is usable, with each injection unit having a plurality of micropumps. Thus fuel is ejected in tiny droplets. Exact fuantily of fuel in small droplets reach the air inlet of the throttle valve and subsequently, following the inlet pipe of the engine, enter the combustion chambers in the cylinders.

Since the present invention utilizes injection by micropumps, an intrinsic driving force in the micropumps of the injection units draws fuel, without any need to apply pressure. An external supply system works by gravitation from a higher positioned fuel tank to ensure steady supply of fuel. Pressure in supply pipes remains very low, and the risk of bursting pipes under high pressure is avoided. The micropumps of the present invention provide for ejected droplets of very small size and allow precisely to control the quantity of ejected fuel, increasing efficiency of the engine.

Furthermore, by a certain arrangement of the injection units at certain positions of the throttle body, and by electric control, every time the engine takes in air, different injection units inject fuel into certain places of the air inlet of the throttle valve. When the throttle valve is opened more widely, certain regions of the inlet manifold have a stratified distribution of fuel-to-air concentration, achieving stratified charge and lean burn process.

The present invention can be more fully understood by reference to the following description and accompanying drawings.

DETAILED DESCRIPTION OF THE PREFERRED EMBODIMENTS

Figure 1:
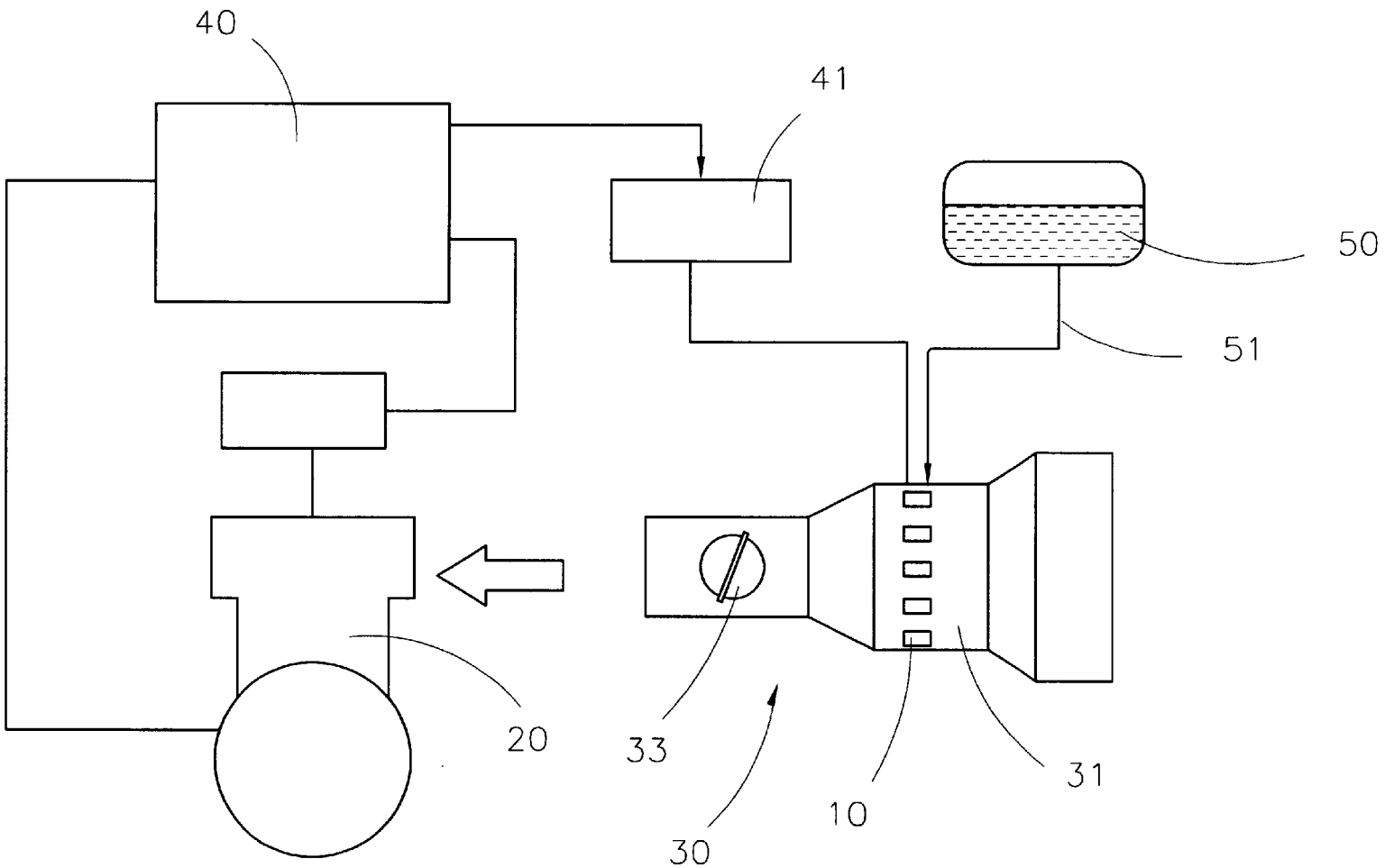
FIG. 1 is a schematic illustration of the micro-pulsation metering fuel injection system of the present invention.

As shown in FIG. 1, the micro-pulsation metering fuel injection system of the present invention in a first embodiment mainly comprises: several injection units 10, arranged at certain positions on a throttle body 30 of a cylinder 20; a electrical control unit 40, controlling operation of the several injection units 10; an fuel tank 50, storing fuel; and several pipes 51, delivering fuel from the fuel tank 50 to the several injection units 10.

The throttle body 30 is placed on an inlet manifold of the cylinder 20, having an air inlet 31 connected to an air filter and allowing air to enter a combustion chamber in the cylinder 20 via the air inlet 31. The throttle body 30 further has a butterfly valve 33, positioned inside the air inlet 31 and controlling the quantity of air flow entering the cylinder 20.

Figure 2:
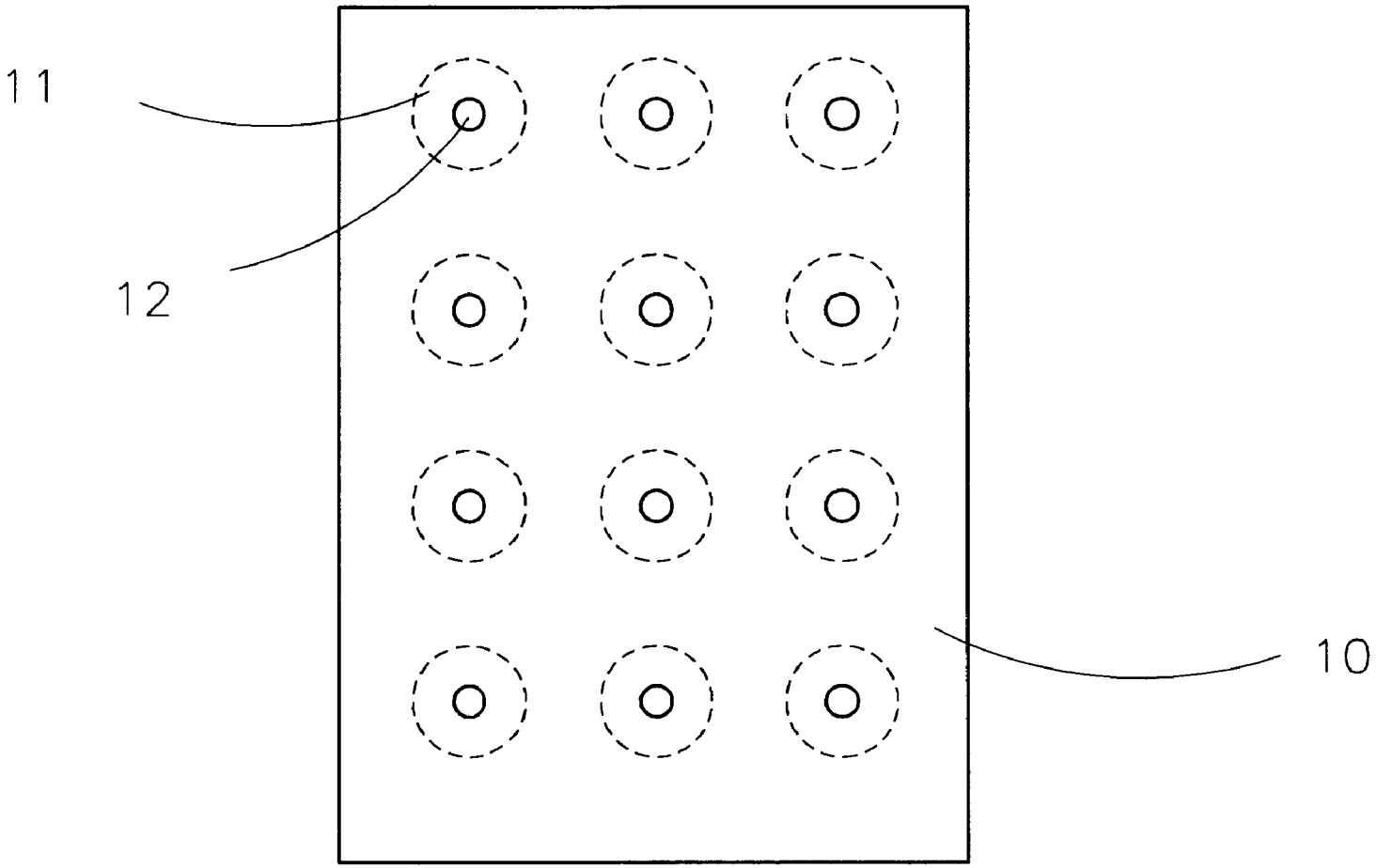
FIG. 2 is an enlarged front view of the injection units of the present invention.

Referring to FIG. 2, every injection unit 10 is provided with a plurality of micropumps 11. Each of the micropumps 11 has a nozzle 12, so that rows of nozzles are formed. The micropumps 11 are thermal bubble micropumps or piezoelectric micropumps. The injection units 10 are controlled by the electrical control unit 40. The control unit 40 has a plurality of detectors for sensing speed and temperature of the engine and the setting of the butterfly valve 33. From there, a central processor in the electrical control unit 40 issues a control signal, feeding a driver unit 41 which drives the micropumps 11 of the injection units 10 to inject fuel according to rotational stages of the status.

Figure 3:
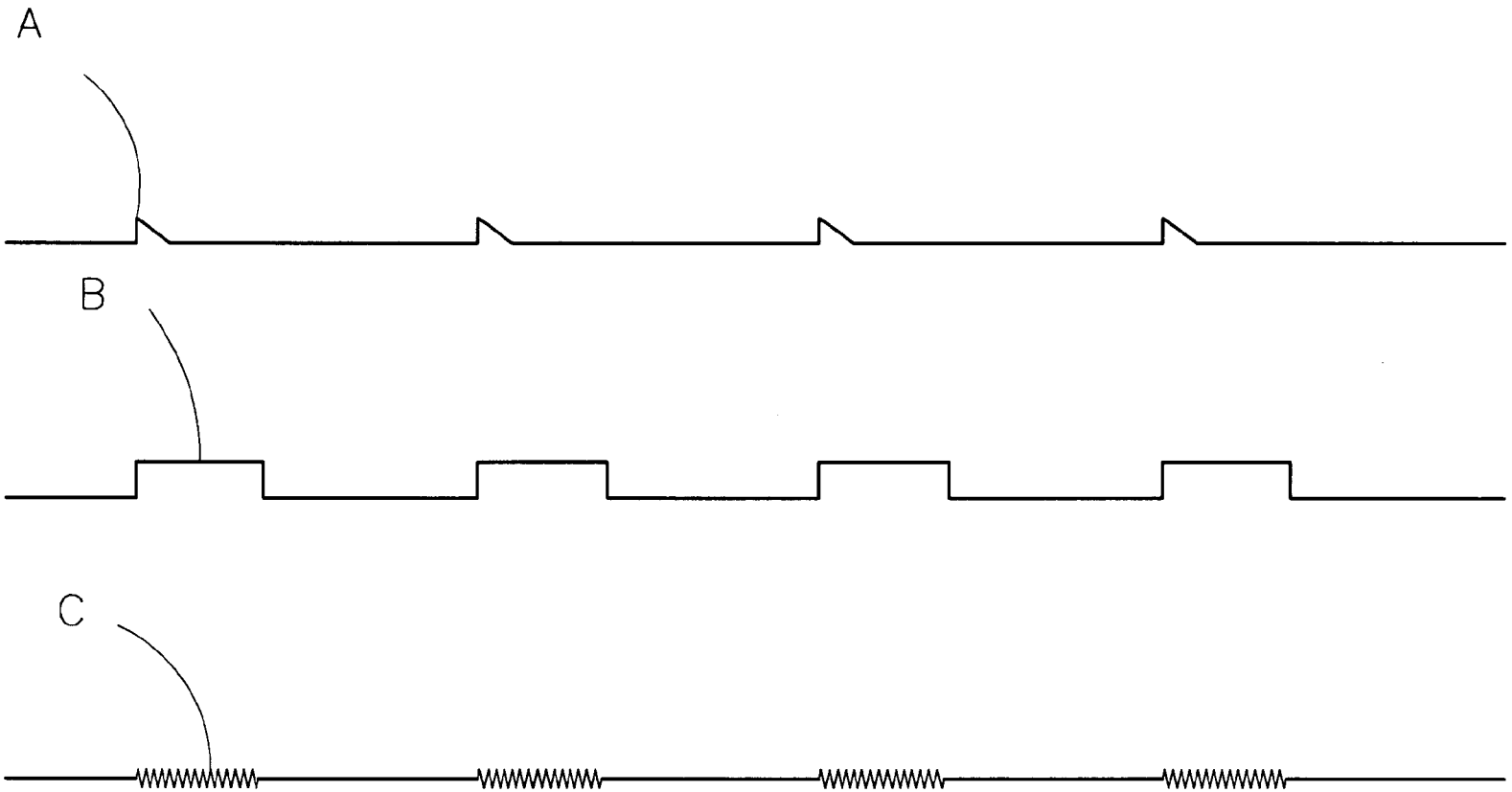
FIG. 3 is a diagram of the control signals of the present invention.

FIG. 3 shows the control signals for the injection units 10. A signal A represents strokes of the engine, having a pronounced amplitude every time a certain stage of the engine comes up. The control unit 40, following the signal A, collects digital data from other detectors and, after processing, issues a signal B for the injection units 10. The signal B is transmitted to the driving unit 41. The driving unit 41 generates a pulsation signal C based thereon for driving the micropumps 11 of the injection units 10. The pulsation signal C has a fixed frequency, causing the injection units 10 to operate at that fixed frequency.

The signal C is active at time intervals that are decided by the duration of the signal B. Thus the electrical control unit 40 is able by issuing the signal B in intervals of certain durations to regulate the quantity of fuel injected by the micropumps. While the signal B given out by the electrical control unit 40 is active, the injection units 10 operate at a fixed frequency, injecting fuel into the throttle body 30. Since the present invention provides for one set or more than one set of injection units 10, it is possible to select from these a single injection unit 10 to inject fuel. When fuel is supplied from various injection units 10, due to different positions thereof in the air inlet of the throttle body different places in the air inlet of the throttle body are provided with fuel. Therefore, when fuel-air mixture enters the combustion chambers of the cylinders of the engine, some regions therein contain mixture of a higher concentration. Thus stratified charge and diluted combustion lean burn are achieved, resulting in higher combustion efficiency and less pollution and fuel consumption.

Since each of the injection units 10 has a plurality of tiny nozzles on micropumps, ejected fuel droplets are of tiny sizes, having relatively little inertia. Furthermore, fuel droplets are ejected at comparatively low speed, about 5 m/sec. Therefore, after ejection fuel droplets suspends in the air inlet of the throttle body and will not accumulate on walls, which is an effective improvement on the problem of wetted walls and improper dispersion regularly found at conventional carburetors and fuel injection systems.

Furthermore, since micropumps work stably, the amount of fuel injected is precisely controllable. Fuel is dispensed into the cylinders in exact quantity, increasing fuel efficiency of the engine.

The micropumps 11 of the injection units 10 have the ability to suck in fuel and then eject dispersed fuel. Therefore, delivering fuel to the injection units 10 is straightforward by different vertical positions of the fuel tank 50 and the throttle body 30, without any need for a fuel pump to apply pressure. In case of an accident or burst of the pipes, there is no high pressure that pushes out fuel, which would be dispersed with a risk of explosion. Safety is thus greatly improved by the present invention.

The injection units 10 of the present invention are made by a semiconductor manufacturing process. No press or other complicated mechanism is needed. Therefore, the present invention, as compared with conventional carburetors and fuel injection systems, has by far lower cost of production.

Figure 5:
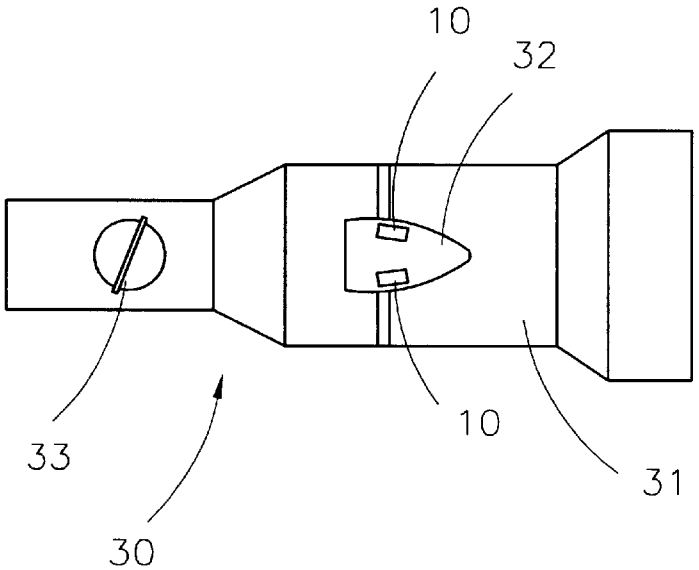
FIG. 5 is a schematic illustration of the present invention in the third embodiment.
Figure 4:
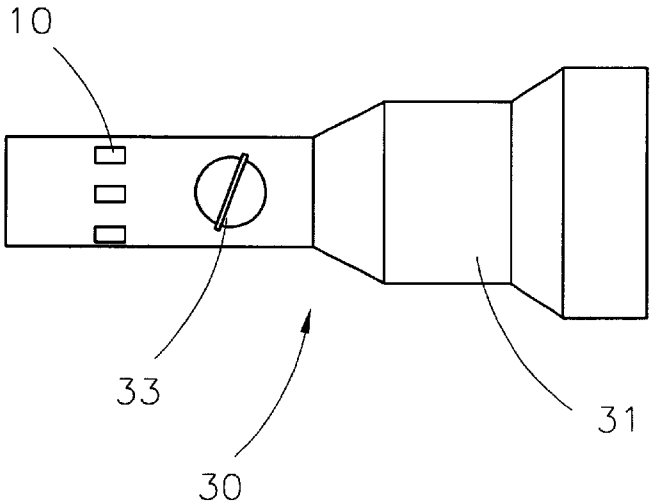
FIG. 4 is a schematic illustration of the present invention in the second embodiment.
Figure 6:
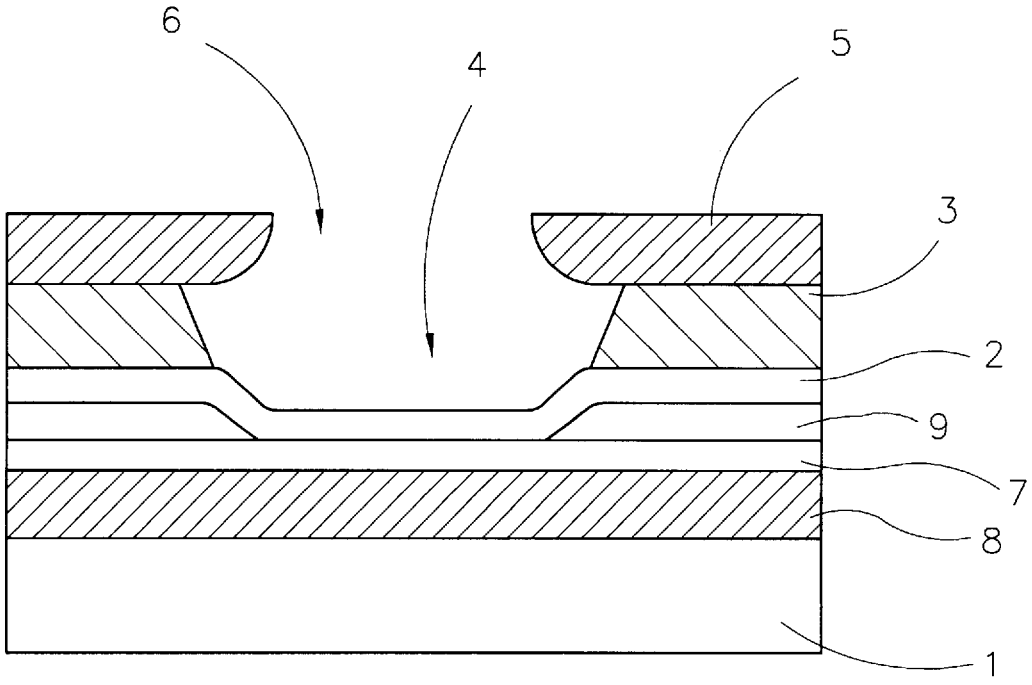
PRIOR ART FIG. 6
FIG. 6 is a schematic illustration of a conventional thermal bubble micropump.
Figure 7:
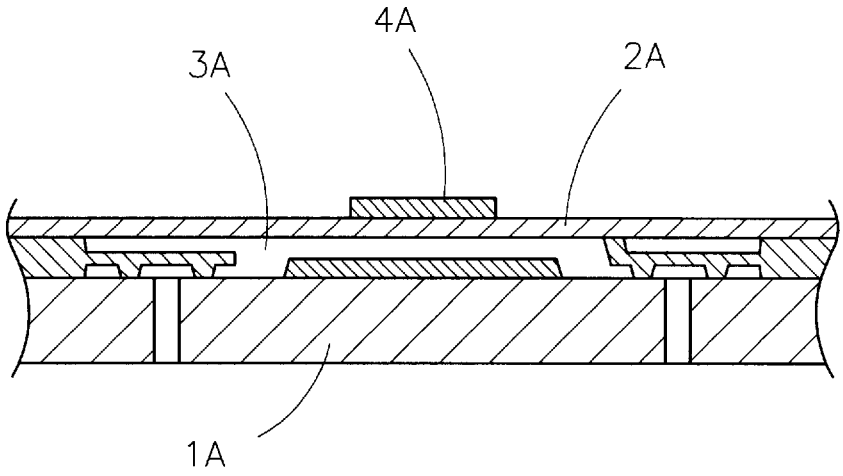
PRIOR ART FIG. 7
FIG. 7 is a schematic illustration of a conventional piezoelectric micropump.
Figure 8:
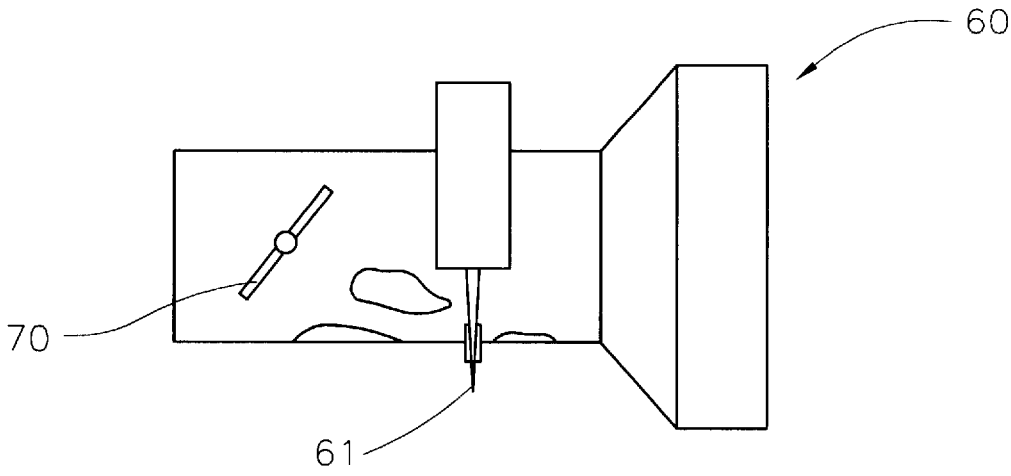
PRIOR ART FIG. 8
FIG. 8 is a schematic illustration of a conventional carburetor.
Figure 9:
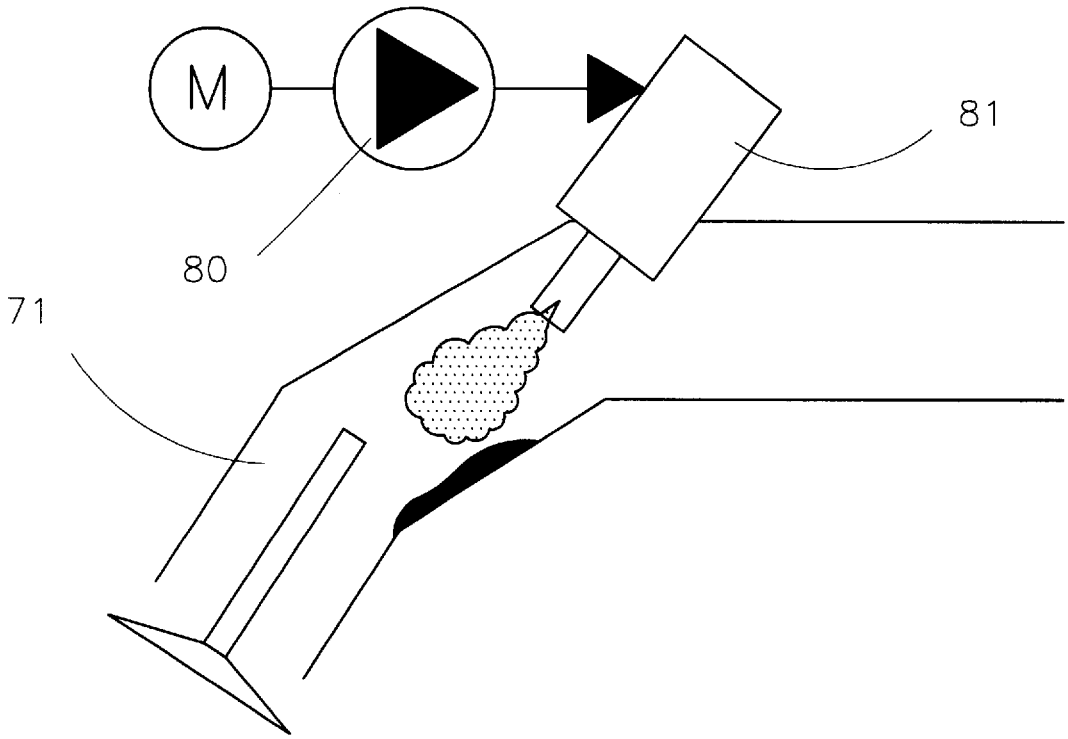
PRIOR ART FIG. 9
FIG. 9 is a schematic illustration of a conventional fuel injection system.

In the embodiment shown in FIG. 1, the injection units 10 are arranged around a tube wall of the air inlet 31 of the throttle body 30, injecting fuel towards a central axis thereof. However, there is a lot of scope of varying the arrangement of the injection units 10. For example, the positions of the injection units 10 on the throttle body 30 are variable. Instead of placing the injection units 10 at an upstream end of the throttle body 30, the injection units 10 are alternatively placed at a downstream end of the throttle body 30, closer to the cylinders, as shown in FIG. 4. In another embodiment, as shown in FIG. 5, a support 32 is mounted inside the air inlet 31 of the throttle body 30, carrying the injection units 10 on an outer side. From there, fuel is ejected outward, away from the central axis of the air inlet 31. To summarize, the injection units 10 are disposable according to various conditions of air flow and at different positions for varying control of combustion.

While the invention has been described with reference to preferred embodiments thereof, it is to be understood that modifications or variations may be easily made without departing from the spirit of this invention which is defined by the appended claims.

What is claimed is:

1. A micro-pulsation metering fuel injection system, comprising:

a throttle body, mounted in an inlet pipe of a cylinder of an internal combustion engine for controlling a quantity of flow of air into a combustion chamber;

at least one pipe for supplying fuel;

at least one injection unit, mounted on said throttle body, connected with said at least one pipe and having a plurality of micropumps which inject tiny droplets of fuel that are delivered by said at least one pipe into an air inlet inside said throttle body at an intermittently variable rate determined by an operating condition of said internal combustion engine, so that said droplets of fuel mix with air in said trottle body, creating a mixture which enters said combustion chamber of said cylinder; wherein injection of said fuel by said plurality of micropumps is controlled by a control unit in response to said operating condition of said internal combustion engine, said control unit performing calculations and issuing an intermittent control signal synchronized with said internal combustion engine, with said plurality of micropumps operating at a fixed frequency during an active phase of said intermittent control signal, and said plurality of micropumps not operating when no signal is received from said control unit.

2. A micro-pulsation metering fuel injection system according to claim 1, wherein said micropumps of said at least one injection unit are thermal bubble micropumps.

3. A micro-pulsation metering fuel injection system according to claim 1, wherein said micropumps of said at least one injection unit are piezoelectric micropumps.

4. A micro-pulsation metering fuel injection system according to claim 1, further comprising a control unit, which, after sensing parameters of operation of said engine and performing computations, controls injection of fuel by said at least one injection unit.

5. A micro-pulsation metering fuel injection system according to claim 1, wherein said at least one injection unit is mounted on an outer wall of said throttle body, injecting fuel towards a central axis of said air inlet.

6. A micro-pulsation metering fuel injection system according to claim 1, wherein said at least one injection unit is mounted on a support, which in turn is mounted on a central axis of said air inlet of said throttle body, injecting fuel from there outwards.

7. A micro-pulsation metering fuel injection system according to claim 1, wherein said at least one injection unit is mounted at an upstream end of said air inlet of said throttle body.

8. A micro-pulsation metering fuel injection system according to claim 1, wherein said at least one injection unit is mounted in said inlet pipe between said throttle body and said cylinder.

9. A micro-pulsation metering fuel injection system according to claim 1, wherein said at least one injection unit is placed on said throttle body in a circular arrangement.

10. A micro-pulsation metering fuel injection system according to claim 1, wherein said at least one micropump of said at least one injection unit is driven by a signal generated by a driver unit.

11. A micro-pulsation metering fuel injection system according to claim 1, wherein said at least one injection unit is mounted at a downstream end of said throttle body, connected with said cylinder.

12. A micro-pulsation metering fuel injection system, comprising:

at least one injection unit, mounted on a tube wall of an air inlet, having at least one micropump and, by said at least one micropump sucking fuel, injecting tiny droplets of fuel into said air inlet, so that said droplets of fuel float inside said air inlet and subsequently enter at an intermittently variable rate determined by an operating condition of an internal combustion engine, along with flowing air, a cylinder of said internal combustion engine; wherein injection of said fuel by said at least one micropump is controlled by a control unit in response to said operating condition of said internal combustion engine, said control unit performing calculations and issuing an intermittent control signal synchronized with said internal combustion engine, with said at least one micropump operating at a fixed frequency during an active phase of said intermittent control signal, and said at least one micropump not operating when no signal is received from said control unit.

13. A micro-pulsation metering fuel injection system according to claim 12, wherein said micropumps of said at least one injection unit are thermal bubble micropumps.

14. A micro-pulsation metering fuel injection system according to claim 12, wherein said micropumps of said at least one injection unit are piezoelectric micropumps.

15. A micro-pulsation metering fuel injection system according to claim 12, further comprising a control unit, which, after sensing parameters of operation of said engine and performing computations, controls injection of fuel by said at least one injection unit.

16. A micro-pulsation metering fuel injection system according to claim 12, wherein said at least one injection unit is mounted on an outer wall of said throttle body, injecting fuel towards a central axis of said air inlet.

17. A micro-pulsation metering fuel injection system according to claim 12, wherein said at least one injection unit is mounted on a support, which in turn is mounted on a central axis of said air inlet of said throttle body, injecting fuel from there outward.

18. A micro-pulsation metering fuel injection system according to claim 12, wherein said at least one injection unit is mounted at an upstream end of said air inlet of said throttle body.

19. A micro-pulsation metering fuel injection system according to claim 12, wherein said at least one injection unit is mounted in said inlet pipe between said throttle body and said cylinder.

* * * * *